United States Patent [19]

Sorlien et al.

[11] Patent Number: 4,657,321

[45] Date of Patent: Apr. 14, 1987

[54] TELECOMMUNICATION SERVICE WIRE CONNECTOR

[75] Inventors: Mark D. Sorlien, White Bear, Minn.; Manuel Filreis, Round Rock; William J. Seim, Austin, both of Tex.

[73] Assignee: Minnesota Mining and Manufacturing Company, St. Paul, Minn.

[21] Appl. No.: 844,941

[22] Filed: Mar. 27, 1986

[51] Int. Cl.[4] ..... H01R 4/24

[52] U.S. Cl. ..... 339/14 R; 339/97 R; 339/223 R; 339/277 R

[58] Field of Search ..... 339/14 R, 14 L, 97 R, 339/97 P, 98, 99 R, 223 R, 277 R

[56] References Cited

U.S. PATENT DOCUMENTS

| | | | |
|---|---|---|---|
| 838,729 | 12/1906 | Lockwood | 339/223 R |
| 3,162,501 | 12/1964 | Wahl | 339/98 |
| 3,656,088 | 4/1972 | Seim | 339/98 |
| 3,760,331 | 9/1973 | Gurley | 339/97 P |
| 3,828,298 | 8/1974 | Schumacher | 339/14 R |
| 3,993,391 | 11/1976 | Vernerey et al. | 339/223 R |
| 4,261,632 | 4/1981 | Narozny | 339/97 R |
| 4,291,935 | 9/1981 | Badoz et al. | 339/97 R |
| 4,385,794 | 5/1983 | Lucius | 339/97 R |
| 4,423,918 | 1/1984 | Filreis et al. | 339/97 P |

OTHER PUBLICATIONS 3M 3800 "Super Can" literature, 1981.

*Primary Examiner*—John McQuade

*Attorney, Agent, or Firm*—Donald M. Sell; James A. Smith; Terryl K. Qualey

[57] ABSTRACT

A telecommunication service wire shield connector stamped and formed from a sheet of metal and having a generally planar elongate base, a ground stud connection tongue extending from one end of the base, a strain relief adjacent the opposite end of the base and having teeth inclined toward the base for engaging the service wire sheath, and a shield connector between the connection tongue and the strain relief and having small teeth inclined toward the base for scraping the service wire shield upon insertion and making electrical connection to the shield.

6 Claims, 5 Drawing Figures

TELECOMMUNICATION SERVICE WIRE CONNECTOR

FIELD OF THE INVENTION

The present invention relates to a telecommunication service wire connector.

BACKGROUND OF THE INVENTION

Telecommunication service wires coming into the home typically include two or three pairs of small diameter insulated copper wires around which is an insulating plastic sleeve followed by a metal shielding layer, such as aluminum foil, and an outer plastic insulating sheath. The pairs of wires provide electrical circuits over which voice, data and low level power may be transmitted into the home. The metal shield in the service wire is provided to shield the conductors from stray electrical fields which might alter the information sent on the pairs of wires. With the increase in data transmission over telephone wires and the increase in data transmission rates, the shield and its connection has taken on an increased importance. However, due to the age of many residential installations and the availability of only cumbersome bolted on connections, in many residences the service wire is connected in the home only by the pairs of insulated copper conductors and there is no connection to ground the service wire shield.

SUMMARY OF THE INVENTION

The present invention provides a telecommunication service wire connector stamped and formed from a sheet of metal with which connection to the shield and strain relief of the service wire is simply provided. The connector comprises a generally planar elongate base, a ground stud connection tongue extending from one end of the base, a strain relief adjacent the opposite end of the base and a shield connector between the ground stud connection tongue and the strain relief. The ground stud connection tongue is formed at its free end with a ground stud connection portion for mechanical and electrical connection to a ground stud and includes an offset portion between the base and the ground stud connection portion positioning the ground stud connection portion in a plane spaced from and generally parallel to the plane of the base. The strain relief comprises mirror image portions having side walls extending upward from opposite edges of the base parallel to each other and strain relief sections extending from one edge of the side walls that is perpendicular to the base and at a nonperpendicular angle to the side walls toward each other. The strain relief sections converge toward the ground stud connection tongue and terminate spaced from each other to define a sheath engaging slot. The facing edges of the strain relief sections defining the sheath engaging slot are formed with teeth inclined toward the base for engaging the service wire sheath to provide strain relief. The shield connector comprises mirror image portions having side walls extending upward from opposite edges of the base parallel to each other and shield connection sections extending from one edge of the side walls that is perpendicular to the base and extending toward each other and terminating spaced from each other to define a shield connection slot. The facing edges of the shield connection sections defining the shield connection slot are formed with small teeth inclined toward the base for scraping the service wire shield upon insertion to make electrical connection thereto.

THE DRAWING

DESCRIPTION OF THE PREFERRED EMBODIMENT

Figure 1:
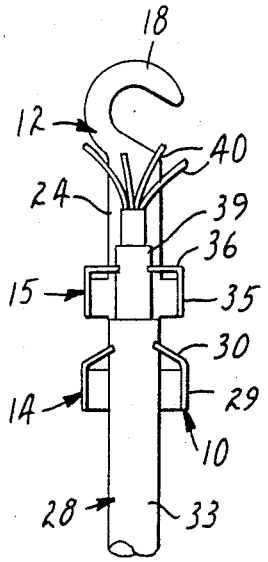
FIG. 1 is a plan view of a telecommunication service wire connector constructed in accordance with the present invention with a service wire connected in it.
Figure 2:
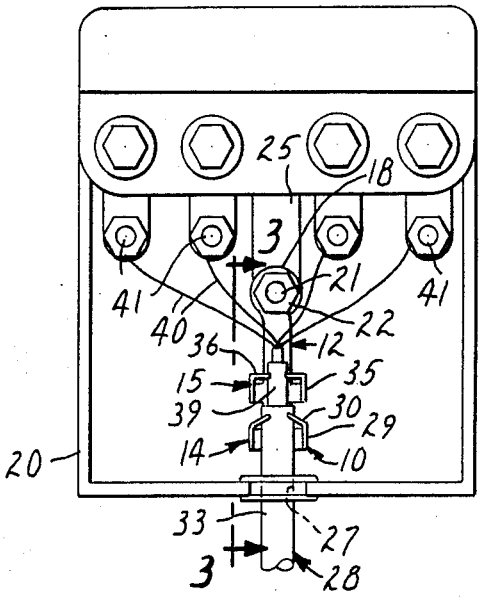
FIG. 2 is a plan view of the service wire connector and service wire in use connected to the terminals in a residential telecommunications entrance box.
Figure 3:
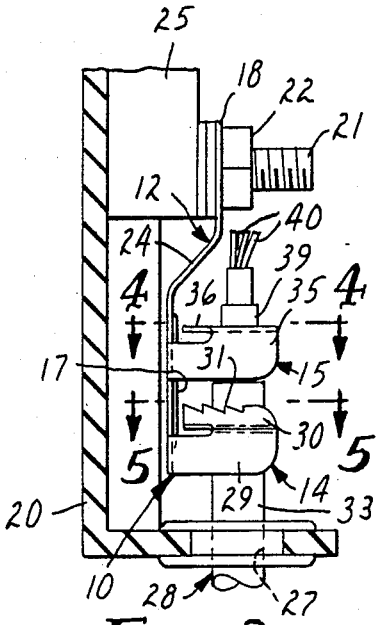
FIG. 3 is a cross sectional view taken generally along line 3—3 of FIG. 2.
Figure 4:
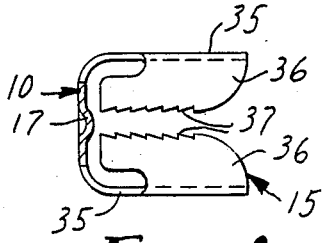
FIG. 4 is a cross sectional view along line 4—4 of FIG. 3 with the service wire removed.
Figure 5:
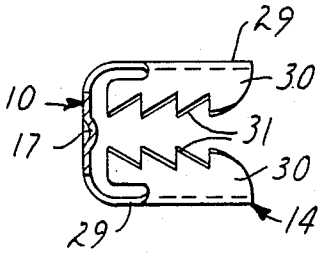
FIG. 5 is a cross sectional view taken along line 5—5 of FIG. 3 with the service wire removed.

The telecommunication service wire connector of the present invention is stamped and formed from a sheet of metal and has a generally planar elongate base 10, a ground stud connection tongue 12 extending from one end of the base, a strain relief 14 adjacent the end of the base opposite the ground stud connection tongue and a shield connector 15 between the ground stud connection tongue 12 and the strain relief 14. A longitudinal strengthening rib 17 is formed in the base centrally of the width thereof and extending along a majority of the length thereof. The ground stud connection tongue 12 is formed at its free end with a ground stud connection portion 18 for a mechanical connection to a ground stud 21 in a residential telecommunications entrance box 20. In the illustrated embodiment the ground stud connection portion 18 is formed as a hook to hook onto the ground stud 21 and be held in place by a nut 22 threaded onto the ground stud 21. The ground stud connection tongue 12 also includes an offset portion 24 between the base 10 and the ground stud connection portion 18 positioning the ground stud connection portion in plane spaced from and generally parallel to the plane of the base. The offset 24 accommodates the fact that in many residential telecommunications entrance boxes 20 the ground stud 21 extends from a portion 25 of the insulating plastic that is raised above the bottom of the box 20 and the aperture 27 through which the service wire 28 enters the box is aligned with the ground stud 21. Thus, the offset 24 permits the service wire 28 to enter the box 20 along its normal path.

The strain relief 14 comprises mirror image portions having side walls 29 extending upward from opposite edges of the base 10 parallel to each other and strain relief sections 30 extending from one edge of the side walls 29 that is perpendicular to the base 10 and at a nonperpendicular angle to the side walls toward each other and converging toward the ground stud connection tongue 12. The strain relief sections 30 terminate spaced from each other to define a sheath engaging slot. The facing edges of the strain relief sections 30 defining the sheath engaging slot are formed with teeth 31 inclined toward the base for engaging the service wire sheath 33.

The shield connector 15 comprises mirror image portions having side walls 35 extending upward from opposite edges of the base 10 parallel to each other and shield connection sections 36 extending from one edge of the side walls 35 that is perpendicular to the base 10 and perpendicular to the side walls 35 toward each other. The shield connection sections 36 terminate spaced from each other to define a shield connection slot. The facing edges of the shield connection sections 36 defining the shield connection slot are formed with small teeth 37 inclined toward the base for scraping the service wire shield 39 upon insertion to make electrical connection thereto. The shield connection teeth 37 are preferably smaller than the strain relief teeth 31 so that the shield connection teeth 37 scrape the aluminum foil shield 39 to make good electrical connection to it without cutting the shield, while the strain relief teeth 31 dig into the tougher plastic sheath 33 to provide good strain relief. The inclination of the strain relief sections 36 so that they converge toward the tongue 12 aids in causing the strain relief teeth 31 to more firmly engage the sheath 33 if the service wire 28 is pulled on externally of the entrance box 20. In the illustrated embodiment there are twice as many shield connection teeth 37 per inch as there are strain relief teeth 31 and the strain relief teeth 31 are approximately twice the depth of the shield connection teeth 37.

In use, the service wire 28 is fed through the aperture 27 into the box 20 and the sheath 33 is cut back to expose the shield 39 and to leave the insulated copper wires 40 extending a distance out of the shield 39. The service wire 28 is then aligned with and pressed into the connector so that the shield 39 is scraped and engaged by the shield connection teeth 37 while the sheath 33 is engaged by the strain relief teeth 31 as illustrated in the drawings. Next, the ground stud connection hook 18 is hooked on the ground stud 21 in the box and the nut 22 is tightened down to make electrical connection from the service wire shield 39 through the connector to the ground stud 21 and to mechanically support the service wire and retain it in the entrance box 20. The ends of the insulated wires 40 are then stripped and connected to the appropriate terminals 41 in the entrance box 20. Typically a cover (not shown) is placed on the box to complete the installation.

In one specific embodiment the service wire connector illustrated in the drawings was made from 0.020 inch thick SAE 1050 hardened spring steel. It was 1.71 inches long with strain relief side walls 29 and shield side walls 35 extending 0.52 inch from the base 10. The shield connection teeth on the opposed shield connection sections 36 were spaced apart 0.074 inch and there were 20 teeth per inch, each tooth being 0.025 in depth. The strain relief teeth 31 on the opposed strain relief sections 30 were spaced apart 0.115 inch and there were 10 teeth per inch with each tooth having a depth of 0.06 inch.

We claim:

1. A telecommunication service wire connector stamped and formed from a sheet of metal, comprising:

a generally planar elongate base, a ground stud connection tongue extending from one end of said base, formed at its free end with a ground stud connection portion for mechanical connection to a ground stud and including an offset portion between said base and said ground stud connection portion positioning said ground stud connection portion in a plane spaced from and generally parallel to the plane of said base, a strain relief adjacent the end of said base opposite said ground stud connection tongue comprising mirror image portions having side walls extending upward from opposite edges of said base parallel to each other and strain relief sections extending from one edge of said side walls that is perpendicular to said base and at a nonperpendicular angle to said side walls toward each other, said strain relief sections converging toward said ground stud connection tongue and terminating spaced from each other to define a sheath engaging slot, the facing edges of said strain relief sections defining said sheath engaging slot being formed with teeth inclined toward said base for engaging the service wire sheath, and a shield connector between said ground stud connection tongue and said strain relief comprising mirror image portions having side walls extending upward from opposite edges of said base parallel to each other and shield connection sections extending from one edge of said side walls that is perpendicular to said base and extending toward each other and terminating spaced from each other to define a shield connection slot, the facing edges of said shield connection sections defining said shield connection slot being formed with small teeth inclined toward said base for scraping the service wire shield upon insertion to make electrical connection thereto.

2. The service wire connector of claim 1 wherein said offset portion of said ground stud connection tongue offsets said ground stud connection portion from the plane of said base about one half the height of said shield connector side walls.

3. The service wire connector of claim 1 including a longitudinal strengthening rib formed in said base centrally of the width thereof and extending along a majority of the length thereof.

4. The service wire connector of claim 1 wherein said ground stud connection portion is formed as a hook.

5. The service wire connector of claim 1 wherein said strain relief teeth are bigger than said shield connection teeth.

6. The service wire connector of claim 1 wherein said shield connection sections are perpendicular to said shield connection side walls.

* * * * *